US008360675B2

(12) United States Patent
Kent et al.

(10) Patent No.: US 8,360,675 B2
(45) **Date of Patent: *Jan. 29, 2013**

(54) ADJUSTABLE TAB FOLDER

(75) Inventors: Michael Kent, Cumberland, RI (US); Chad Kendall, Peabody, MA (US); Kara Brunetta, Worcester, MA (US); Patrick Conway, Westford, MA (US); Irene Wong, Malden, MA (US)

(73) Assignee: Staples The Office Superstore, LLC, Framingham, MA (US)

( * ) Notice: Subject to any disclaimer, the term of this patent is extended or adjusted under 35 U.S.C. 154(b) by 524 days.

This patent is subject to a terminal disclaimer.

(21) Appl. No.: 12/563,519

(22) Filed: Sep. 21, 2009

(65) Prior Publication Data

US 2010/0116872 A1 May 13, 2010

Related U.S. Application Data

(63) Continuation-in-part of application No. 12/268,500, filed on Nov. 11, 2008, now Pat. No. 7,731,442.

(51) Int. Cl.
*B41J 3/407* (2006.01)

(52) U.S. Cl. ..... 402/79; 40/641; 208/425

(58) Field of Classification Search ..... 402/502, 402/73, 70, 79, 80 P, 80 R; 229/67.2; 206/425
See application file for complete search history.

(56) References Cited

U.S. PATENT DOCUMENTS

| | | | |
|---|---|---|---|
| 795,609 | A | 7/1905 | Hendrickson |
| 1,705,753 | A | 3/1929 | Dawson |
| 1,741,066 | A | 12/1929 | Morgan |
| 1,899,382 | A | 2/1933 | Berry |
| 1,975,662 | A | 10/1934 | Rand |
| 2,122,223 | A | 6/1938 | Von Dollen |
| 2,969,793 | A | 1/1961 | Furrer |
| 3,204,639 | A | 9/1965 | Kleffman |
| 3,590,511 | A | 7/1971 | Heimann |
| 4,400,107 | A | 8/1983 | Pitts |
| 4,445,711 | A | 5/1984 | Cunningham |
| D275,576 | S | 9/1984 | Kirk |
| 4,905,393 | A | 3/1990 | Laurie |

(Continued)

FOREIGN PATENT DOCUMENTS

| | | |
|---|---|---|
| BE | 560 471 | 9/1957 |
| DE | 855 393 | 7/1949 |

(Continued)

OTHER PUBLICATIONS

International Search Report and Written Opinion from co-pending PCT application No. US2009/005911 dated Mar. 1, 2010.

*Primary Examiner* — Dana Ross
*Assistant Examiner* — Matthew G Katcoff
(74) *Attorney, Agent, or Firm* — Wolfe, Greenfield & Sacks, P.C.

(57) ABSTRACT

Embodiments described herein relate to dividers and folders with tabs adjustable along at least two edges thereof. One embodiment is directed to a folder comprising a first panel, a second panel coupled to the first panel, at least one tab mating feature associated with the second panel, and a tab configured to mate with the at least one tab mating feature. The at least one tab mating feature is configured such that the tab is positionable in at least two positions along a first axis adjacent a first edge of the second panel and in at least two positions along a second axis adjacent a second edge of the second panel, wherein the first axis is transverse to the second axis.

17 Claims, 14 Drawing Sheets

U.S. PATENT DOCUMENTS

| | | | | |
|---|---|---|---|---|
| 5,135,261 | A | 8/1992 | Cusack | |
| 5,226,734 | A | 7/1993 | Scott et al. | |
| 5,503,487 | A | 4/1996 | Ong | |
| 5,540,513 | A | 7/1996 | Wyant | |
| 5,707,001 | A | 1/1998 | Mark et al. | |
| 5,875,579 | A | 3/1999 | Winzen | |
| 5,909,979 | A | 6/1999 | Winzen | |
| 5,953,843 | A | 9/1999 | Collins et al. | |
| D416,939 | S | 11/1999 | Marsy | |
| 5,996,881 | A | 12/1999 | Smith | |
| D421,050 | S | 2/2000 | Henrikson et al. | |
| 6,042,291 | A | 3/2000 | Ho | |
| D443,895 | S | 6/2001 | Pfanner et al. | |
| 6,273,630 | B1 | 8/2001 | Sgro et al. | |
| 6,361,639 | B1 | 3/2002 | Owen et al. | |
| 6,409,409 | B2 | 6/2002 | Bauman et al. | |
| D478,124 | S | 8/2003 | Yamamoto et al. | |
| 6,632,042 | B1 | 10/2003 | Liener Chin et al. | |
| 6,732,461 | B2 | 5/2004 | Slattery et al. | |
| 6,736,428 | B1 | 5/2004 | Insalaco | |
| 6,752,559 | B2 | 6/2004 | Sapienza et al. | |
| 6,851,718 | B2 | 2/2005 | Liener Chin et al. | |
| D522,575 | S | 6/2006 | Smith | |
| D522,576 | S | 6/2006 | Smith | |
| 7,125,050 | B2 | 10/2006 | Yamamoto et al. | |
| 7,140,644 | B2 | 11/2006 | Hanes | |
| 7,240,443 | B2 | 7/2007 | Nathanson et al. | |
| 7,240,773 | B2 * | 7/2007 | Baumgartner | 188/71.9 |
| 7,334,363 | B1 | 2/2008 | Hansen | |
| D567,286 | S | 4/2008 | Takahashi | |
| 7,383,652 | B2 | 6/2008 | Glasberg | |
| 7,389,598 | B2 | 6/2008 | Bunger et al. | |
| D601,624 | S | 10/2009 | Barausky et al. | |
| D602,524 | S | 10/2009 | Wong et al. | |
| 7,731,442 | B2 * | 6/2010 | Barausky et al. | 402/79 |
| 7,980,779 | B2 * | 7/2011 | Barausky et al. | 402/79 |
| 2003/0126779 | A1 | 7/2003 | Sato et al. | |
| 2005/0093290 | A1 | 5/2005 | Richied | |
| 2005/0225075 | A1 * | 10/2005 | Glasberg | 283/36 |
| 2006/0076771 | A1 | 4/2006 | Schafer | |
| 2006/0225322 | A1 | 10/2006 | O'Leary et al. | |
| 2007/0019053 | A1 | 1/2007 | Sato et al. | |
| 2007/0031180 | A1 | 2/2007 | Grogan | |
| 2007/0234601 | A1 | 10/2007 | Yoo et al. | |

FOREIGN PATENT DOCUMENTS

| | | |
|---|---|---|
| DE | 1 093 331 | 11/1960 |

* cited by examiner

ADJUSTABLE TAB FOLDER

CROSS-REFERENCE TO RELATED APPLICATION

This application claims a priority benefit, under 35 U.S.C. §120, as a continuation-in-part (CIP) of U.S. Non-provisional patent application Ser. No. 12/268,500, filed Nov. 11, 2008, entitled "Adjustable Tab Divider."

BACKGROUND

Some document dividers (e.g., for use in binders) and folders include tabs to facilitate quick access to the divider or folder and identify documents associated therewith. Conventionally, the tabs are integrally formed with the divider or folder at fixed locations. Such tabbed dividers or folders are generally sold in sets with the tabs in a set being formed at different locations. In particular, the tabs are formed so that, when the dividers or folders are stacked, each tab is visible (i.e., not obstructed by another tab). For example, each tab may be offset from each successive tab in the set by some increment.

The fixed location of the tabs leads to disadvantages. For example, when a plurality of dividers or folders having integrally formed tabs are used as a set, the insertion, removal, and rearrangement of the dividers or folders may disrupt the orderly progression of the tabs, resulting in the obstruction of some tabs by other tabs and a generally disorganized appearance.

To address the disadvantages that result from using fixed tabs, dividers and folders with repositionable tabs have been developed. A divider having a repositionable tab is described in U.S. Pat. No. 5,503,487 ("Ong"). The divider of Ong includes a tab that may be removed and repositioned by removing the ears from one pair of neighboring slots and introducing the ears into a different pair having a different longitudinal location. U.S. Publication No. 2003/0126779 ("Sato et al.") describes another type of repositionable-tab divider. In particular, Sato et al. describes a divider having a tab that may be repositioned by sliding the tab along a rail. A folder having a repositionable tab is described in U.S. Pat. No. 4,905,393 ("Laurie"). The folder of Laurie includes a repositionable tab designed to slide on an edge of the folder.

While being able to reposition a tab on a divider or folder overcomes some of the drawbacks associated with those having integrally formed tabs, existing tabbed dividers and folders still suffer from limitations. Accordingly, improvements are needed.

SUMMARY

One embodiment described herein is directed to a divider for use in a binder. The divider comprises a panel, the panel comprising a binding edge and a plurality of non-binding edges, and a tab. The panel comprises at least one binding feature adjacent the binding edge and at least one tab mating feature adjacent at least first and second edges of the plurality of non-binding edges. The tab is configured to mate with the at least one tab mating feature. The at least one tab mating feature is configured such that the tab is positionable in at least two longitudinal positions along the first non-binding edge and in at least two longitudinal positions along the second non-binding edge.

Another embodiment described herein is directed to a method of adjusting a tab on a divider, the divider comprising a panel having a binding edge and a plurality of non-binding edges. The method comprises moving the tab from a first position along a first non-binding edge to a second position along a second non-binding edge, and providing the tab with information identifying content demarcated by the tab.

A further embodiment described herein is directed to a divider for use in a binder, the divider comprising a panel comprising a binding edge and a plurality of non-binding edges. The panel comprises a plurality of holes to receive binder rings adjacent the binding edge and a track adjacent first and second non-binding edges of the plurality of non-binding edges, wherein the track comprises a first track portion adjacent the first non-binding edge, a second track portion adjacent the second non-binding edge and oriented perpendicular to the first track portion, and a corner track portion adjoining the first and second track portions. The divider further comprises a tab comprising a track-mating portion configured to couple the tab to the track in a manner such that the tab is slidable along the track from the first track portion to the second track portion via the corner track portion.

Another embodiment described herein is directed to a folder. The folder comprises a first panel comprising a first inner-facing surface and a first outer-facing surface and a second panel, coupled to the first panel, comprising a second inner-facing surface and a second outer-facing surface. The first and second panels are arranged such that at least a portion of the first inner-facing surface is adjacent at least a portion of the second inner-facing surface. The folder further comprises at least one tab mating feature associated with the second panel and a tab configured to mate with the at least one tab mating feature. The at least one tab mating feature is configured such that the tab is positionable in at least two positions along a first axis adjacent a first edge of the second panel and in at least two positions along a second axis adjacent a second edge of the second panel, wherein the first axis is transverse to the second axis.

A further embodiment described herein is directed to a method of adjusting a tab on a folder. The folder comprises a first panel, a second panel coupled to the first panel, at least one tab mating feature associated with the second panel, and a tab configured to mate with the at least one tab mating feature. The method comprises introducing at least one item between the first and second panels, moving the tab from a first position along a first edge of the second panel to a second position along a second edge of the second panel, and providing the tab with information relating to the at least one item.

Another embodiment described herein relates to a folder comprising a first panel comprising a first inner-facing surface and a first outer-facing surface and a second panel, coupled to the first panel, comprising a second inner-facing surface and a second outer-facing surface. The first and second panels are arranged such that at least a portion of the first inner-facing surface is adjacent at least a portion of the second inner-facing surface. The folder further comprises a track comprising a first track portion adjacent a first edge of the second panel and oriented along a first axis, a second track portion adjacent a second edge of the second panel and oriented along a second axis transverse to the first axis, and a corner track portion adjoining the first and second track portions. The folder also comprises a tab comprising a track-mating portion configured to couple the tab to the track in a manner such that the tab is slidable along the track from the first track portion to the second track portion via the corner track portion.

DETAILED DESCRIPTION

While being able to reposition a tab on a divider or folder overcomes some of the drawbacks associated with integrally formed tabs, existing dividers and folders still suffer from limitations. For example, when more than a relatively small number of tabs is used, some tabs will necessarily be obstructed by others. Further, existing dividers and folders have limited options for tab location.

In view of the foregoing, it is desirable to provide a divider or folder that has a greater number of non-overlapping positions in which the tab may be positioned, to increase the number of dividers or folders that may be used together without substantial overlap of the tabs. In addition, it is desirable to provide a divider or folder having flexibility with respect to the edge along which a tab is positioned. The dividers and folders of embodiments described below may advantageously exhibit these features according to some implementations.

Figure 1:
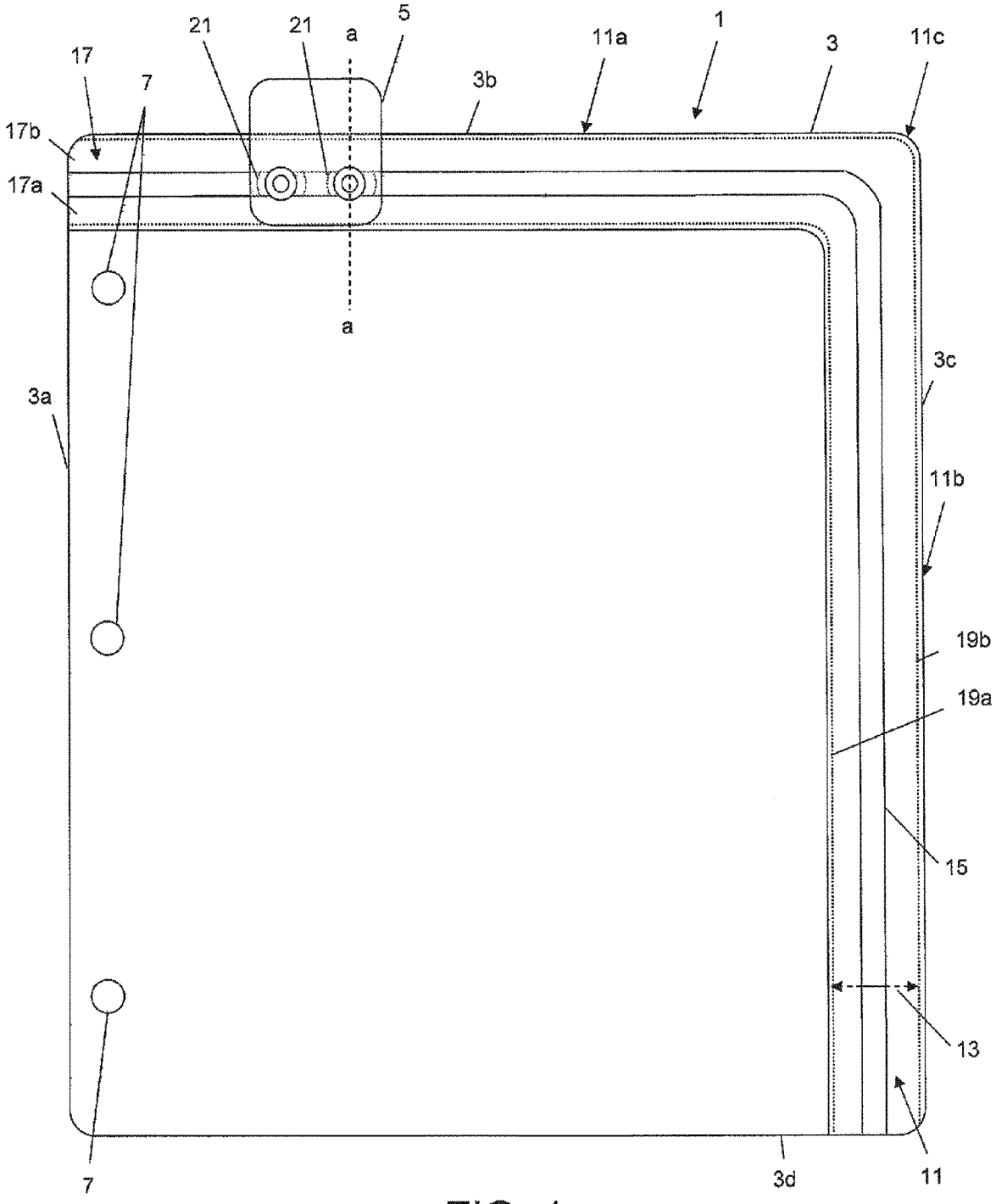
FIG. 1 shows a front view of a divider having a slidable tab.

FIGS. 1-4 illustrate one embodiment of a divider having a repositionable tab. The divider may be used to divide sections of paper, such as sections of loose leaf paper held by a binder. As shown in FIG. 1, the divider 1 includes a panel 3 and a tab 5. According to one exemplary implementation, the panel 3 may be sized to approximate the size of loose leaf paper. For example, the divider may be approximately 8.5 inches wide and approximately 11 inches long. The panel 3 comprises a binding edge 3*a* and three non-binding or free edges 3*b*, 3*c* and 3*d*. Adjacent the binding edge 3*a*, the panel comprises three holes 7, which are sized and positioned to each receive a ring of a three-ring binder. For example, the holes 7 may have a spacing of approximately 4.25 inches and may each have a diameter of approximately 0.25 inches. Other numbers of holes, spacing of the holes, and shapes and dimensions of the holes are possible.

The panel 3 comprises a track 11 along which the tab 5 is movable. In the exemplary embodiment of FIGS. 1-4, the track 11 extends along two non-binding edges. In particular, the track 11 comprises a first track portion 11*a* adjacent non-binding edge 3*b*, a second track portion 11*b* adjacent non-binding edge 3*c* and oriented perpendicular to the first track portion, and a corner track portion 11*c* adjoining the first and second track portions. Alternatively, however, the track 11 may include track portions adjacent non-binding edges 3*c* and 3*d* with a corner track portion adjoining the two, or track portions adjacent non-binding edges 3*b*, 3*c* and 3*d* with corner track portions adjoining the adjacent track portions.

In the embodiment of FIGS. 1-4, the track 11 comprises a slot 13 having a opening 15. The opening 15 is defined by a first side 17*a* and second side 17*b* of a slot covering 17. In an exemplary implementation, both the panel 3 and the slot covering 17 are formed of a thermoplastic polymer or other material. For example, the panel 3 and the slot covering 17 may be formed of polypropylene. In the exemplary embodiment of FIGS. 1-4, the slot covering 17 is coupled to the panel 3 with heat welds 19*a* and 19*b* respectively associated with the first side 17*a* and second side 17*b* of a slot covering 17. The panel 3 and slot covering 17 are melted together along the heat welds 19*a* and 19*b*.

The tab 5 is slidable along the track 11. The tab 5 comprises disks 21 that are received within the slot 13 to form a mating connection. The disks 21 are slidable within the slot 13 along the first track portion 11*a*, second track portion 11*b*, and corner track portion 11*c*. To facilitate sliding the disks 21 about corner track portion 11*c*, the corner track portion may be curved, as shown in FIG. 1.

Figure 2:
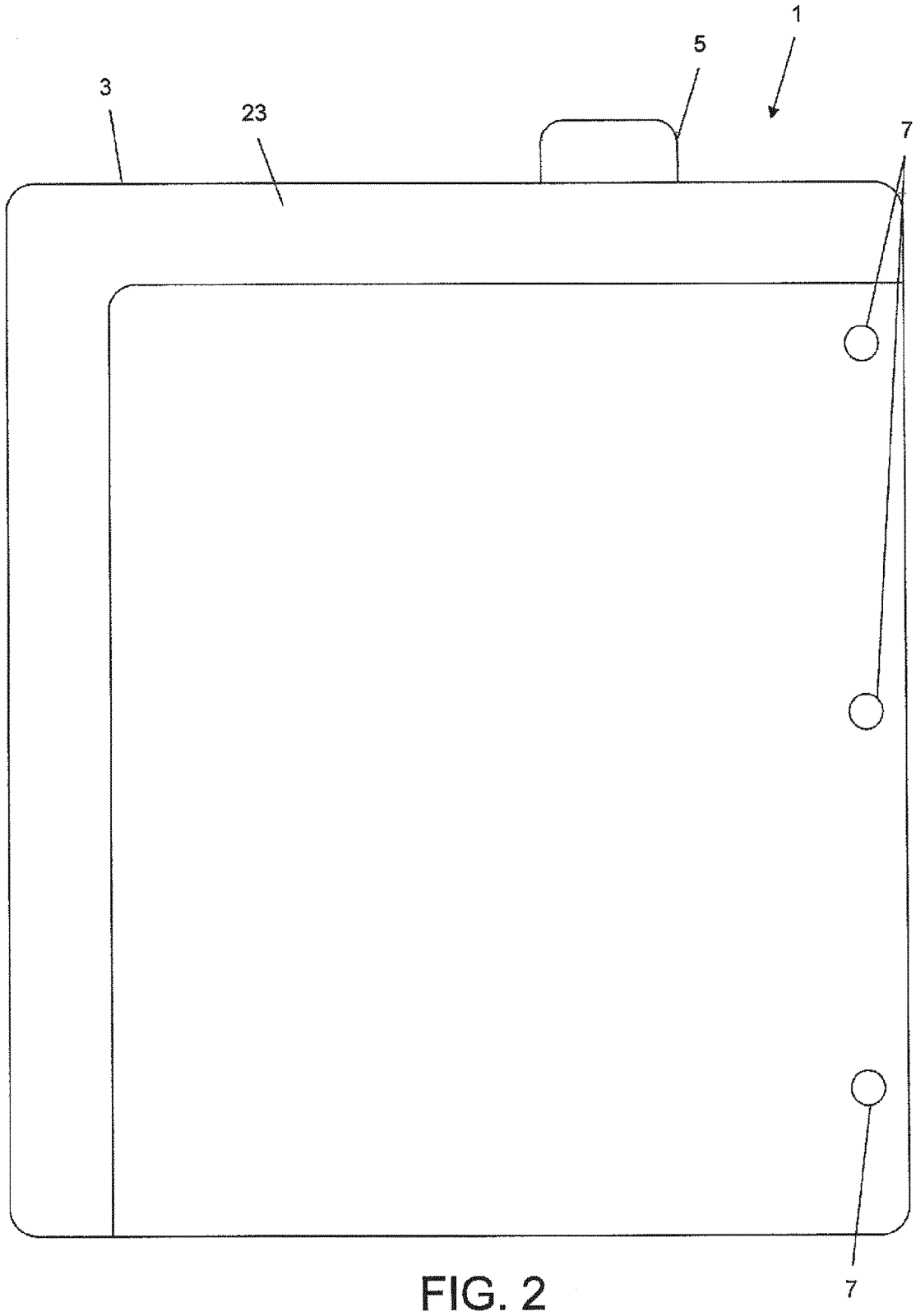
FIG. 2 shows a rear view of the divider shown in FIG. 1.

FIG. 2 shows a rear view of the divider 1. As shown, the rear side of the panel 3 includes a reinforcement panel portion 23 that may be optionally coupled adjacent the rear side of the track 11. The reinforcement panel portion 23 may be used to reinforce the track 11 and/or provide greater stiffness. The reinforcement panel portion 23 may be coupled to the panel 3 with an adhesive, heat weld, or other attachment means. Further, the reinforcement panel portion 23 may be separately or integrally formed with panel 3.

Figure 3:
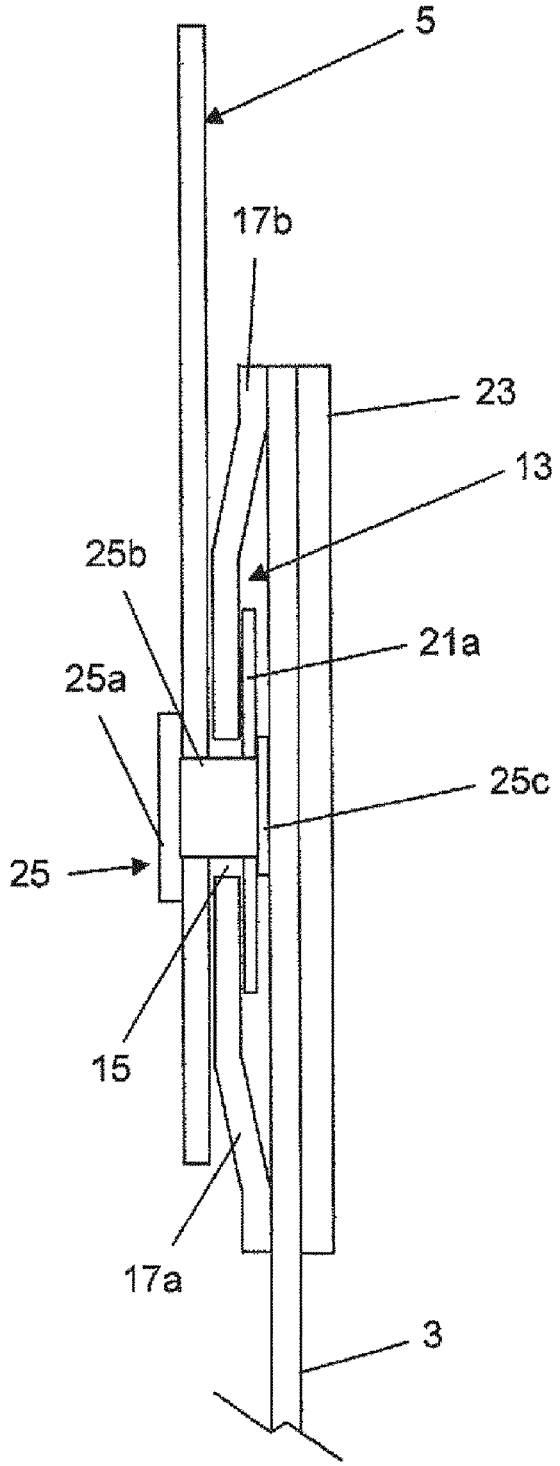
FIG. 3 shows a cross-sectional view of the mating interface between the tab and the track of the divider shown in FIG. 1, taken across line a-a in FIG. 1.

FIG. 3 shows a cross-sectional view of the mating interface between the tab 5 and the track 11, taken across line a-a in FIG. 1. The disks 21 are coupled to the tab 5 via fasteners 25, which may comprise eyelets, rivets, brads, or other fastening means. The fasteners 25 each comprise a head 25*a*, a post 25*b* and a base 25*c*. The head 25*a* of the fastener 25 is located exterior to the slot 13 and is coupled to the post 25*b*. The post 25*b* of the fastener passes through the tab 5 and the slot opening 15. The base 25*c* of the fastener 25, which is also coupled to the post 25*b*, is located interior to the slot 13, between the disk 21 and the panel 3. The post 25*b* has a smaller diameter than the slot opening 15 and is movable along the slot opening. The disk 21 slides within the slot 13 and has a sufficiently larger diameter than the slot opening 15 to prevent the tab 5 from detaching from the track 11.

Figure 4:
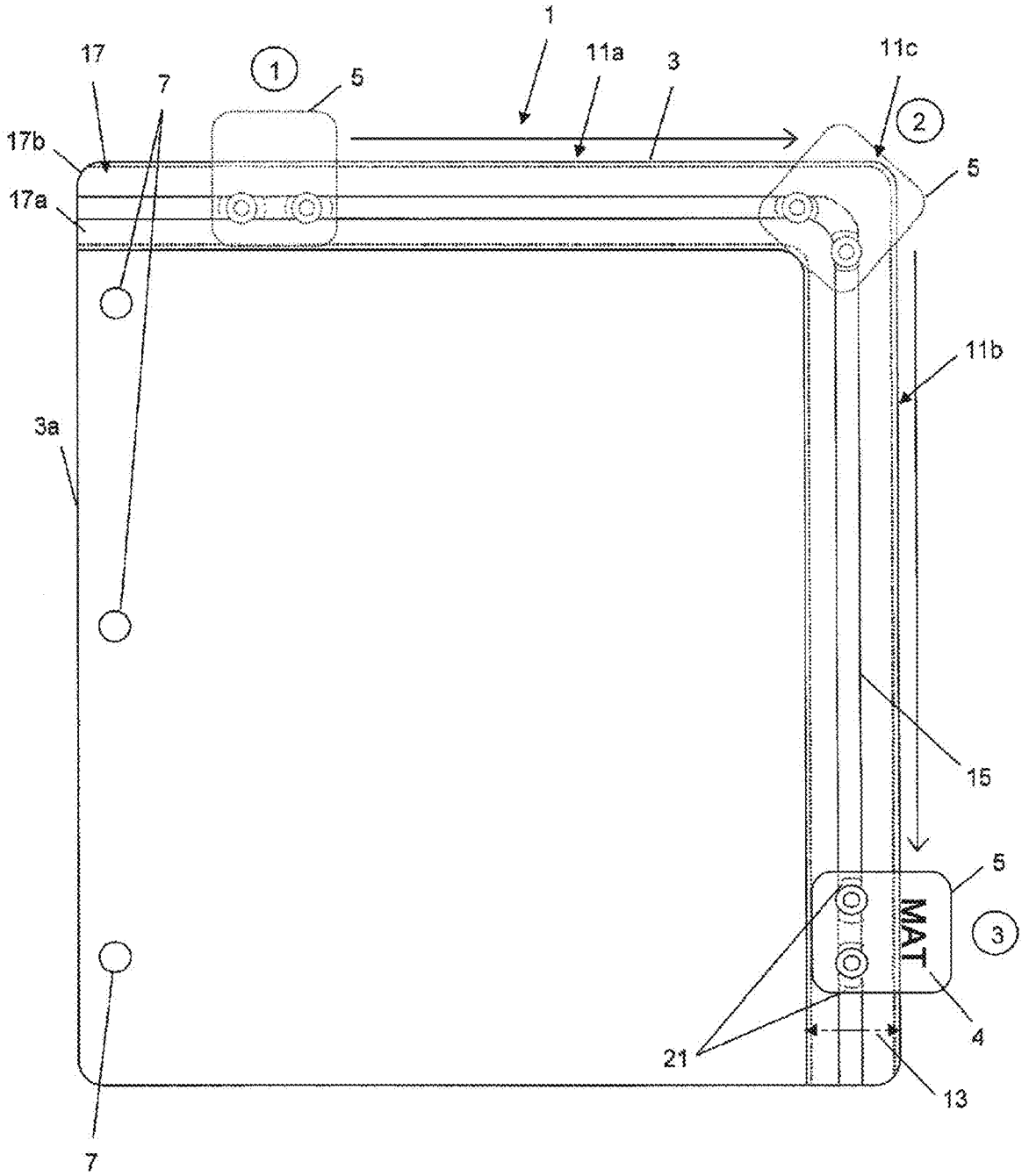
FIG. 4 shows a method of adjusting the tab of the divider shown in FIG. 1.

FIG. 4 illustrates a method of adjusting the position of the tab 5 on the panel 3. As shown, the tab 5 may be slid about a corner from an initial position along a first track portion having a first longitudinal axis to a final position along a second track portion having a second longitudinal axis perpendicular to the first longitudinal axis. In position (1), the tab 5 is positioned along the first track portion 11*a*. By grasping the tab 5 and sliding the disks 21 longitudinally within the slot 13, the tab 5 may be moved to position (2) at the corner track portion 11*c*. By sliding the tab 5 a further distance, the tab 5 may be moved to position (3) along the second track portion 11*b*. The transition between positions (1) and (3) may be performed by sliding the tab 5 continuously or incrementally.

The tabs described herein may be provided with information identifying a portion of the contents of the binder that is demarcated by the tab. The information may be written, typed, or printed on the tab. Alternatively, information may be written, typed, or printed on a label or insert associated with the tab. In FIG. 4, information 4 identifying a section in a binder is handwritten on a front surface of the tab 5.

Figure 8:
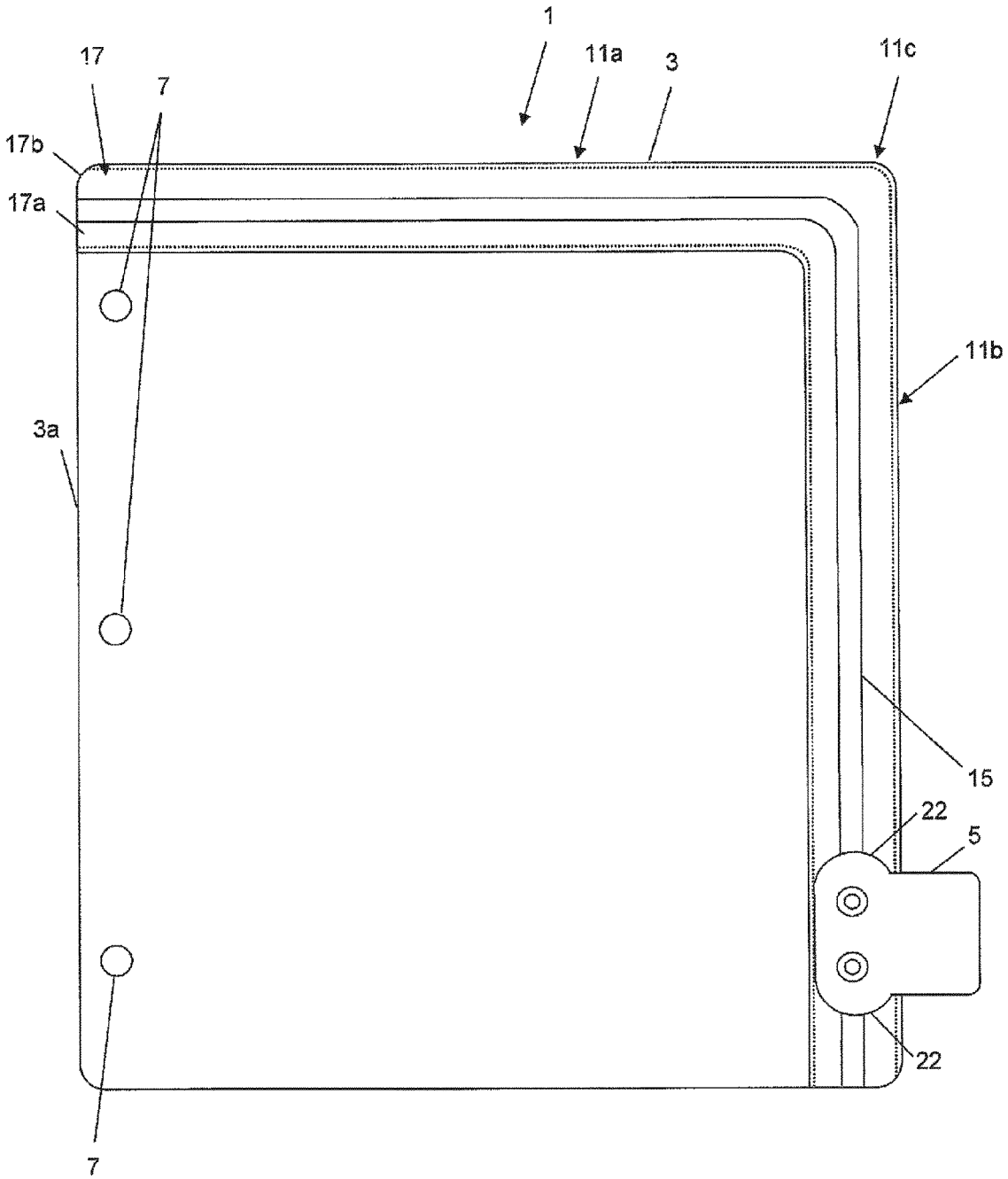
FIG. 8 shows a front view of a divider having a slidable tab.
Figure 9:
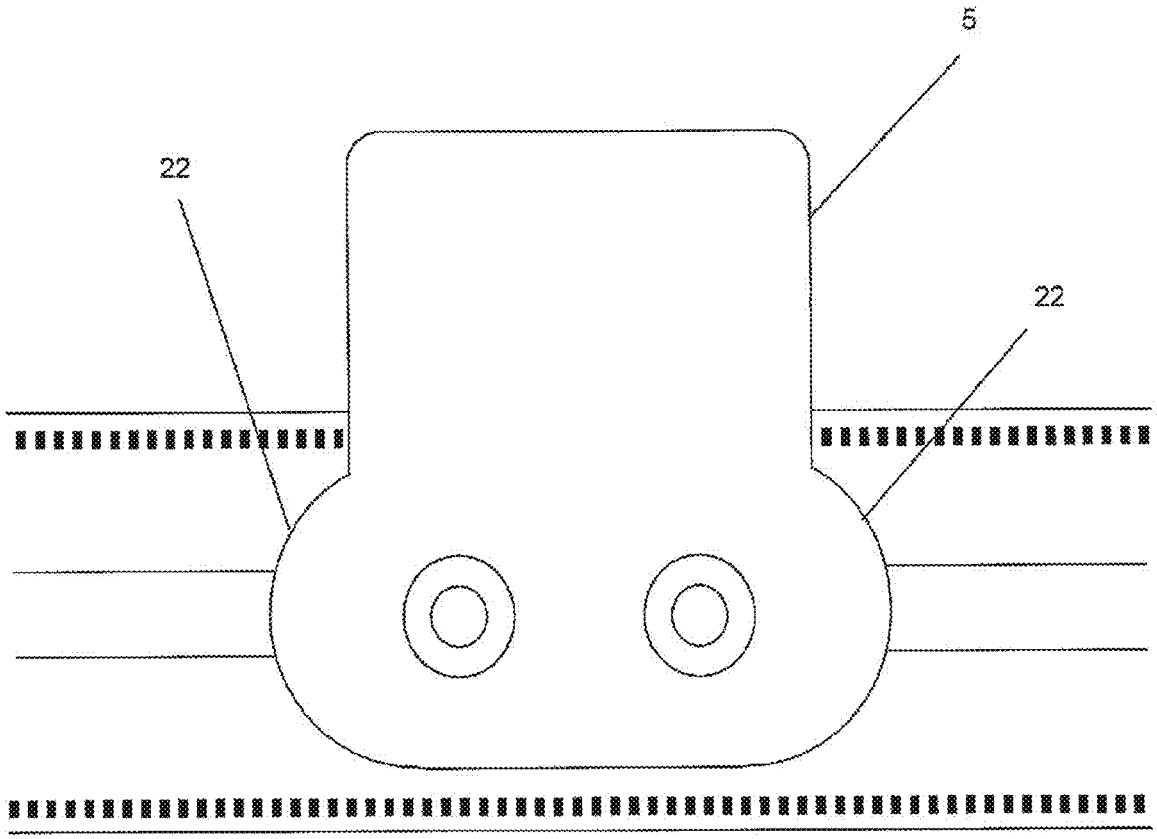
FIG. 9 shows the slidable tab shown in FIG. 8.

It should be appreciated that the size and shape of the tab 5 may vary according to different embodiments of the present invention. In the embodiment illustrated in FIG. 1, the tab 5 is substantially rectangular shaped. In another embodiment shown in FIGS. 8 and 9, the tab 5 has a wing-shaped portion 22 that wraps around the disks 21. In this embodiment, the outer shape of a portion of the tab 5 may substantially follow the circular contour of the disks 21.

Although the track 11 of FIGS. 1-4 comprises slot 13 having an opening 15, many alternative implementations for the track are possible. For example, the track 11 may comprise a rail to which the tab 5 is slidably coupled. For example, a tab mating feature may wrap partially or wholly around the rail, and may be slidable along the rail. The rail may comprise, for example, a strip of polypropylene.

Figure 5:
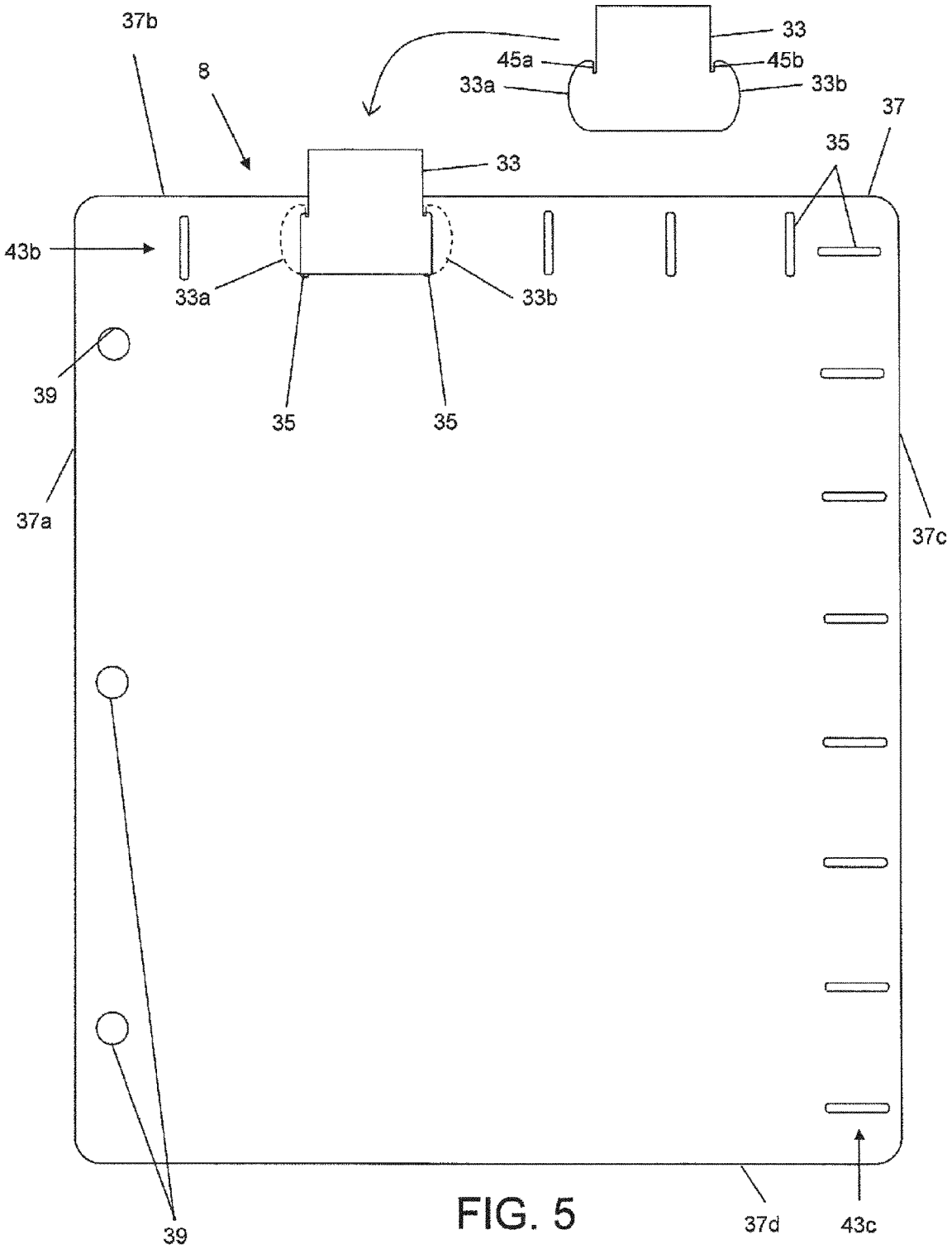
FIG. 5 shows a front view of a divider having a removable tab positioned along a top edge of the divider.
Figure 6:
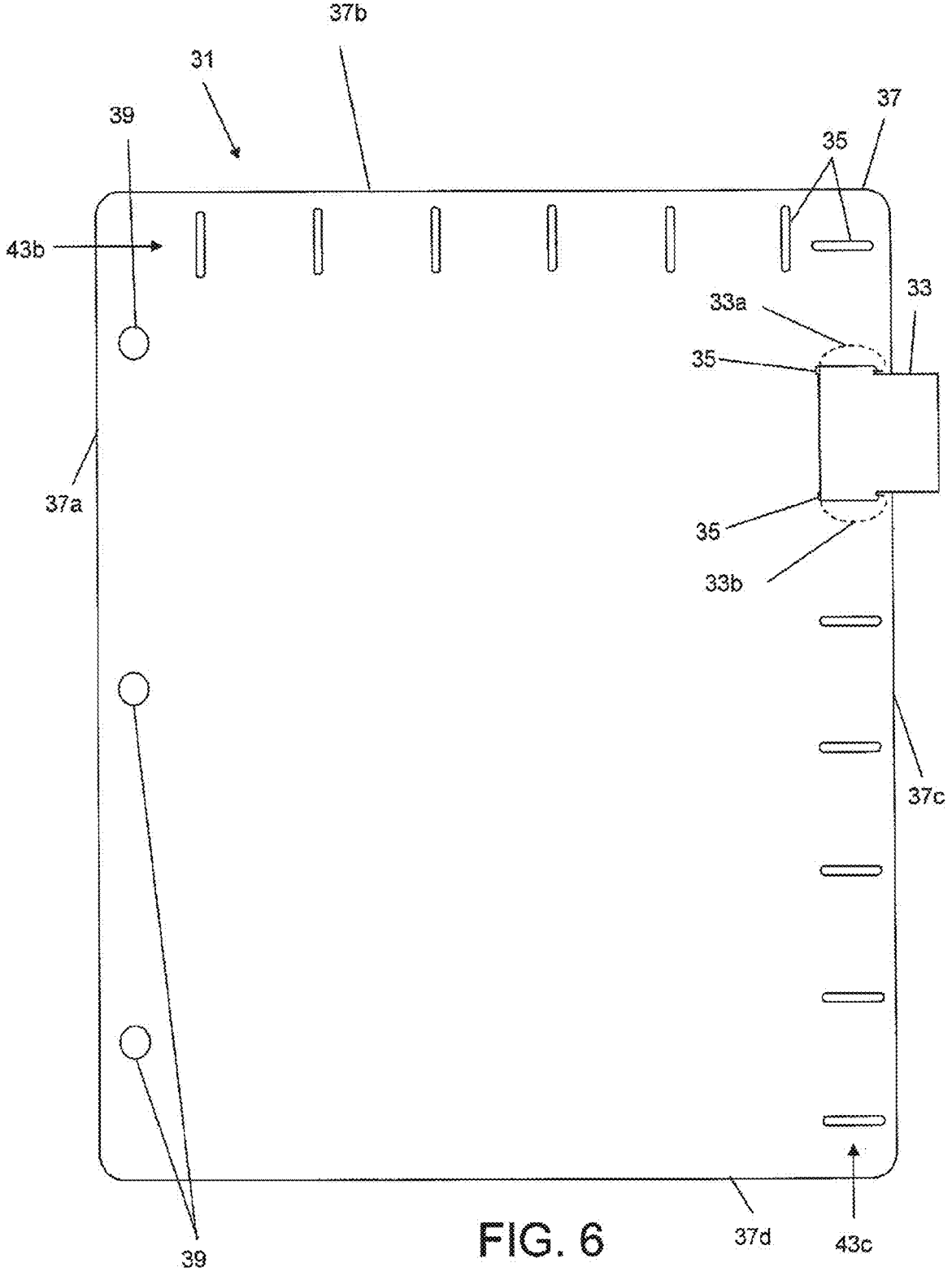
FIG. 6 shows a front view of the divider of FIG. 5 having the removable tab positioned along a right edge of the divider.

FIGS. 5-6 illustrate another embodiment of a divider having a repositionable tab. Like the embodiment described in connection with FIGS. 1-4, the divider may be used to divide sections of paper, such as loose leaf paper held by a binder. As shown in FIG. 5, the divider 31 includes a panel 37 and a tab 33. The panel 37 may be sized to approximate the size of loose leaf paper. For example, the divider may be approximately 8.5 inches wide and approximately 11 inches long. The panel 37 comprises a binding edge 37*a* and three non-binding or free edges 37*b*, 37*c* and 37*d*. Adjacent the binding edge 37*a*, the panel 37 comprises three holes 39, which are sized and positioned to each receive a ring of a three-ring binder. The holes 39, for example, may have a spacing of approximately 4.25 inches and may each have a diameter of approximately 0.25 inches.

The panel 37 comprises a plurality of rows of slots 35 along which the tab 33 is positionable. In the exemplary embodiment of FIGS. 5-7, the rows extend along two non-binding edges. In particular, row 43*b* extends along non-binding edge 37*b* and row 43*c* extends along non-binding edge 37*c*. Alternatively, however, the rows may extend along non-binding edges 37*c* and 37*d* or along non-binding edges 37*b*, 37*c* and 37*d*. The rows may comprise various numbers of slots 35 based, for example, on a desired number of slot pairs that may accommodate a tab and/or a desired width of the tabs. According to one example, the divider 31 comprises five slot pairs (six slots) along non-binding edge 37*b* and/or along non-binding edge 37*d* and eight slot pairs (nine slots) along non-binding edge 37*c*. According to another example, the divider 31 comprises four slot pairs (five slows) along non-binding edge 37*b* and/or along non-binding edge 37*d* and five slot pairs (six slots) along non-binding edge 37*c*.

The slots 35 may be sized to accommodate ears 33*a* and 33*b* of the tab 33. For example, the slots 35 may have approximately the same height as the height of the ears 33*a* and 33*b*. The ears 33*a* and 33*b* may be inserted into adjacent slots 35. The ears 33*a* and 33*b* may include notches 45*a* and 45*b* to interface with the panel 37 adjacent the slots 35 and hold the tab 33 in place one inserted.

FIG. 5 illustrates the tab 33 positioned along non-binding edge 37*b*, and FIG. 6 illustrates the tab 33 repositioned along non-binding edge 37*c*. The size of the tab 33 and the location of the slots 35 relative to the edge of the panel 37 may be selected such that the tab extends beyond the edge when inserted into the slots.

Figure 7:
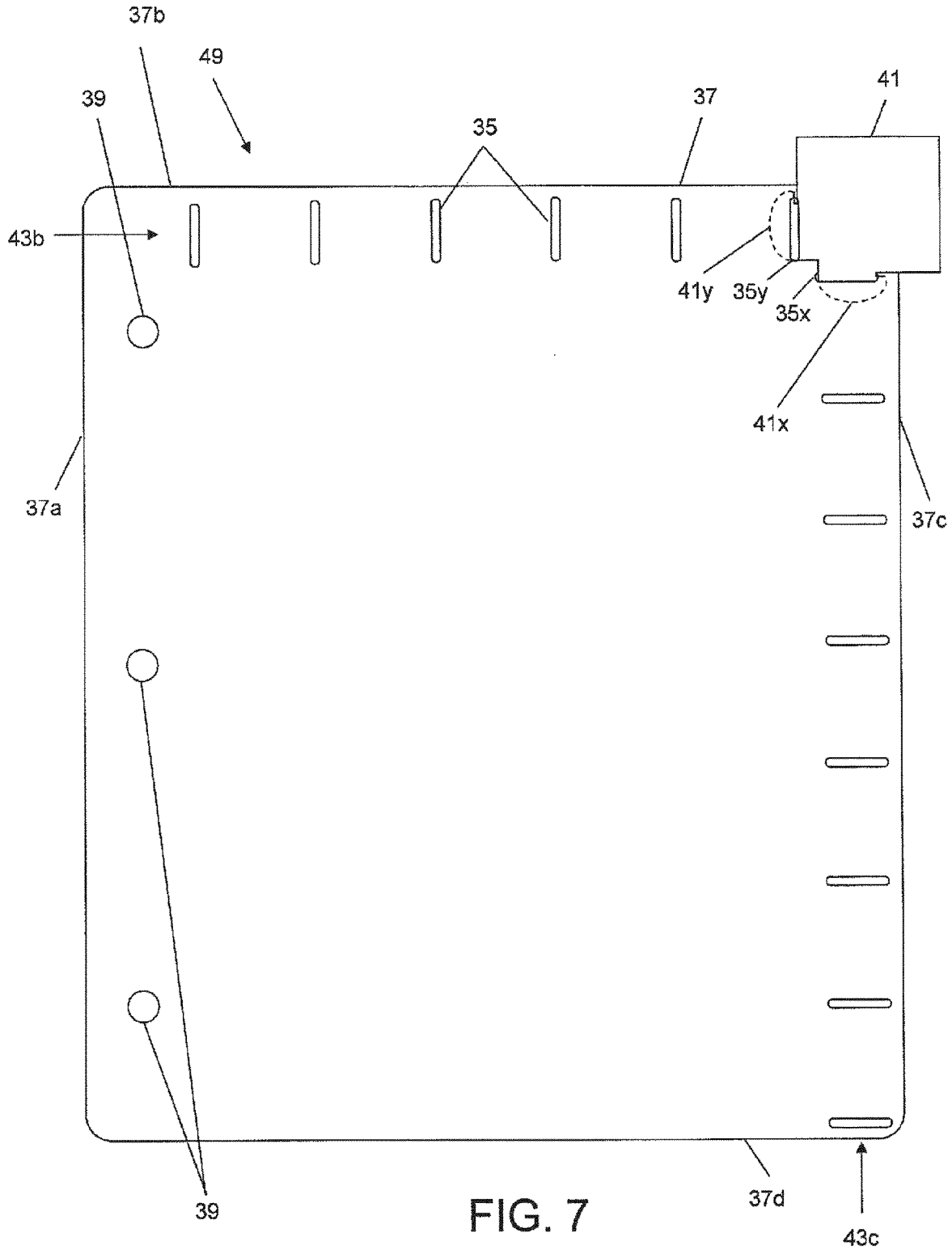
FIG. 7 shows a front view of a divider having a removable tab positioned at a corner of the divider.

FIG. 7 illustrates a further embodiment of a divider having a repositionable tab. The divider 49 of FIG. 7 is similar to the divider 31 of FIGS. 5 and 6, but includes slots 35 positioned to accommodate a corner tab 41. In particular, slot 35*x* is oriented along an x-axis, and slot 35*y* is oriented along a y-axis perpendicular to the x-axis. Similarly, tab 41 includes an ear 41*x* oriented along an x-axis, and an ear 41*y* oriented along a y-axis perpendicular to the x-axis. Slot 35*x* receives ear 41*x* of the tab 41, and slot 35*y* receives ear 41*y*. Alternatively or additionally, the tab 33 of FIGS. 5 and 6 may be positioned along the rows 43*a* and/or 43*b* of the divider 31.

The dividers described herein are not limited to use with three-ring binders. The dividers may alternatively be used in books, notebooks, portfolios, or other bound or non-bound items in which dividers may be useful. In the case of bound items, the binding means may comprise holes, adhesive, a spine, staples, a clamping mechanism, or other binding mechanisms. The dividers may be any suitable size, and may have a portrait or landscape configuration. That is, the top and bottom edges of a divider may be smaller or larger than its side edges.

Further, the repositionable tab configurations and methods described in connection with FIGS. 1-9 may be applied to other types of school supplies, office supplies, or organizational tools in which a repositionable tab may be useful. For example, the repositionable tab configurations and methods described in connection with FIGS. 1-9 may be applied to a folder or other receptacle for holding sheets of paper or other items.

Figure 10:
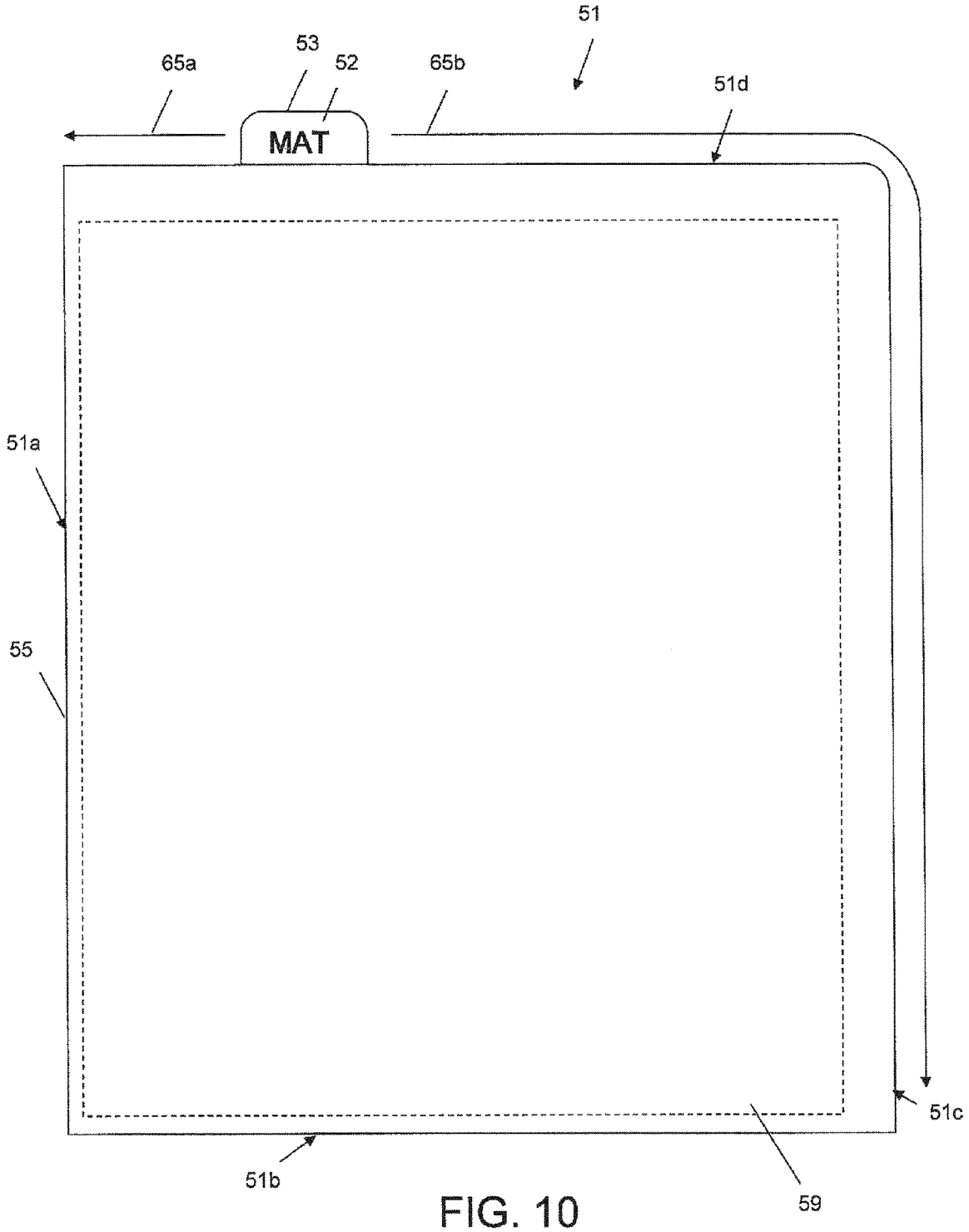
FIG. 10 shows a front view of a folder having a slidable tab.
Figure 11:
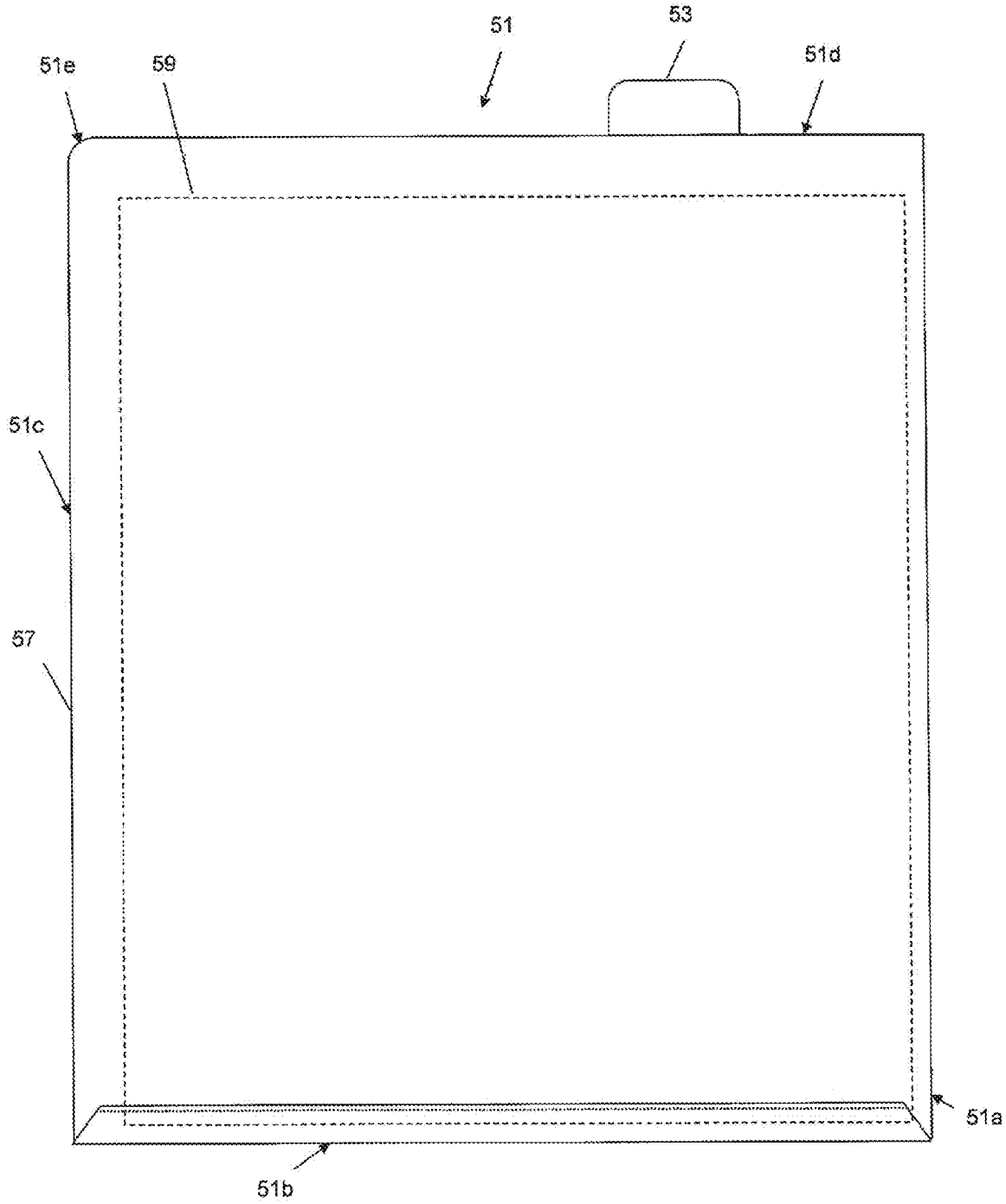
FIG. 11 shows a rear view of the folder shown in FIG. 10.
Figure 12:
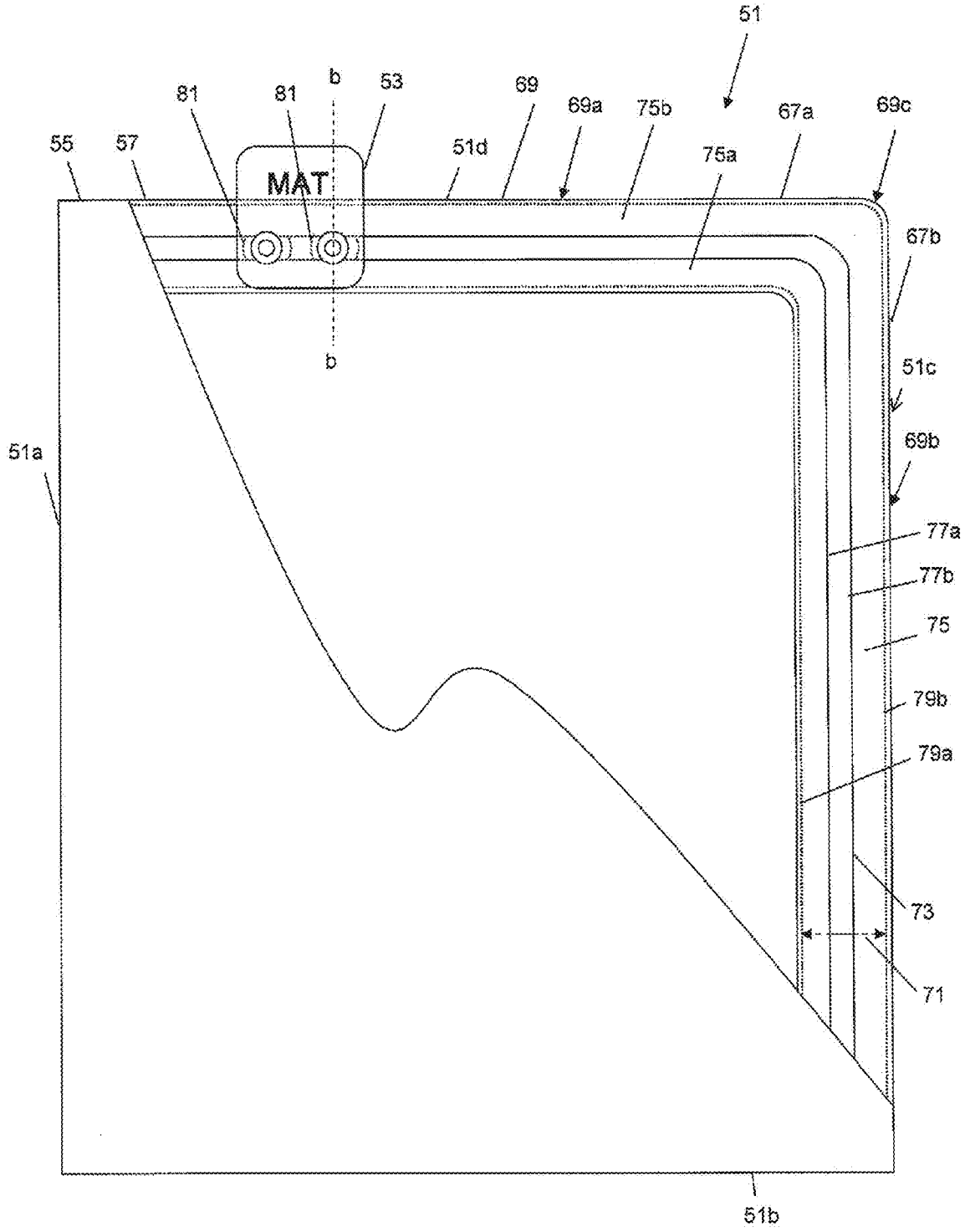
FIG. 12 shows a cut away view of the folder shown in FIG. 10 that illustrates a portion of the inside of the folder.
Figure 13:
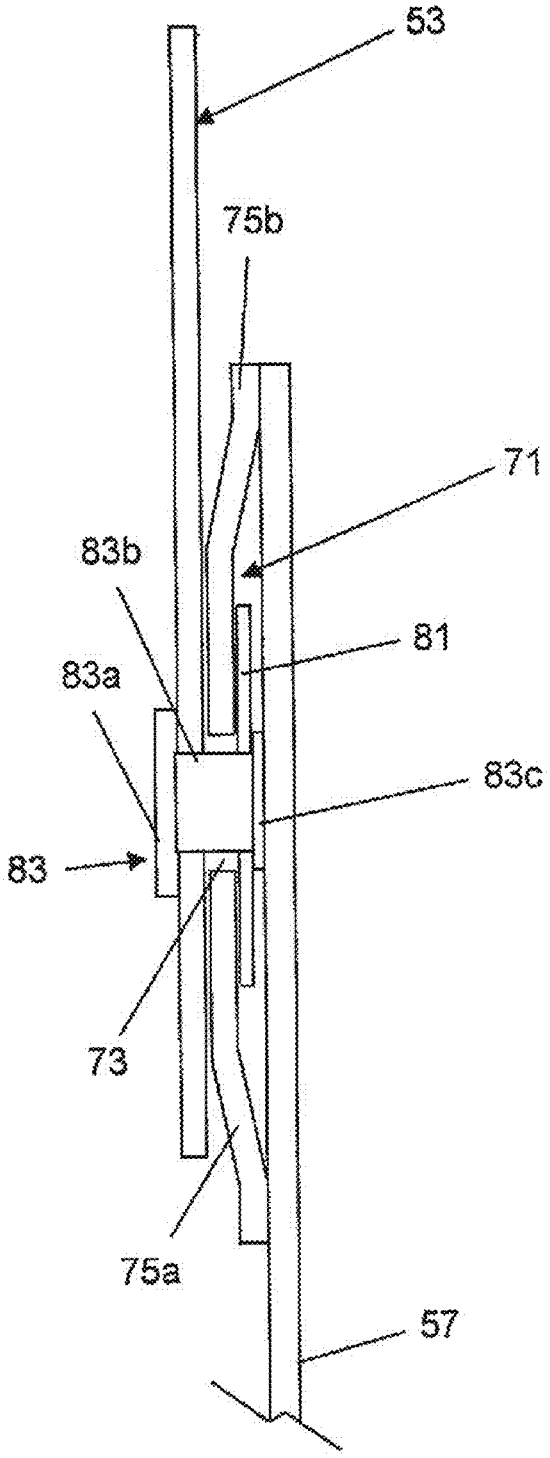
FIG. 13 shows a cross-sectional view of the mating interface between the tab and the track of the folder shown in FIG. 10, taken across line b-b in FIG. 10.

FIGS. 10-13 show an exemplary embodiment of a folder 51 having a repositionable tab 53. In particular, FIG. 10 shows a front view of the folder 51, FIG. 11 shows a rear view the folder, FIG. 12 shows a cut away view of the folder showing a portion of the inside of the folder, and FIG. 13 shows a cross-sectional view of the mating interface between the tab 53 and a track along which the tab is repositionable, taken across line b-b in FIG. 12. As will be described in connection with FIG. 12, the tab 53 may be repositioned by sliding the tab as indicated by the arrows 65*a* and 65*b* shown in FIG. 10.

The folder includes a front panel 55 (FIG. 10) and a rear panel 57 (FIG. 11). The front and rear panels 55 and 57 are coupled along a left edge 51*a* and a bottom edge 51*b* of the folder 51, and are not coupled along a right edge 51*c* and a top edge 51*d* of the folder. Thus, the folder has a pocket-like structure, with an opening along the right and top edges 51*c*, 51*d* thereof. According to other implementations, the folder may include, for example, an opening along three edges (e.g., the top, right and bottom edges), or just one edge (e.g., the top or right edge).

Sheets of paper 59 or other materials may be introduced into the folder 51 via the opening and held between the front and rear panels 55 and 57. The tab 53 may be provided with typed or written information 52 related to the item or items introduced into the folder. For example, an individual may label the tab "MATH," as shown in FIG. 10, to indicate that the sheets of paper 59 held by the folder 51 relate to this subject. As other examples, the tab 53 may be labeled "BABY PHOTOS" to indicate that baby photos are held by the folder 51 or "JAZZ" to indicate that jazz compact discs are held by the folder.

The folder 51 may be sized to accommodate a standard paper size, such as letter (8.5 inches by 11 inches), legal (8.5 inches by 14 inches paper) or ledger (11 inches by 17 inches). To accommodate letter size paper, for example, the folder 51 may have dimensions slightly larger than 8.5 inches by 11 inches, such as 9 inches by 11.5 inches or some approximation thereof. Other sizes, aspect ratios, and shapes are also possible. For example, the folder 51 may be dimensioned to accommodate other sizes of paper or other types of items (e.g., photographs, compact discs and DVDs).

In the embodiment of FIGS. 10-13, the front and rear panels 55 and 57 are formed of a unitary sheet that has been assembled to form the pocket-like structure. The sheet is folded along the left edge 51*a* of the folder 51, dividing the sheet into front and rear panels 55 and 57. The front and rear panels are joined along the bottom edge 51*b* of the folder. In particular, as shown in FIG. 11, a folded flap 61 of the front panel 55 is coupled to the rear panel 57 to adjoin the two panels. According to one exemplary implementation, the front and rear panels are formed of a unitary sheet of polypropylene, or another thermoplastic elastomer, and the folded flap 61 is coupled to the rear panel 57 by a heat weld 63.

The cut away view of FIG. 12 shows an inner-facing surface 67 of rear panel 57, which includes a track 69 along which the tab 53 is movable. The inner-facing surface 67 of the rear panel 57 is adjacent an inner-facing surface (not shown) of the front panel 55. According to this embodiment, the track 69 extends along top and right edges of the inner-facing surface 67. In particular, the track 69 comprises a first track portion 69*a* adjacent top edge 67*a*, a second track portion 69*b* adjacent right edge 67*b* and oriented perpendicular to the first track portion, and a corner track portion 69*c* adjoining the first and second track portions. Alternatively, however, the track 67 may include track portions adjacent other or additional edges, and/or may be formed on another surface of the folder 51. For example, the track may be formed on the outer-facing surface of the front panel 55 adjacent any or all of top, left, right and bottom edges and may include corner track portions adjoining the portions along the edges. The folder could also be implemented such that one or more track portions are not adjacent an edge of the folder. Further, the track portions could be formed along transverse axes that are not perpendicular, as other angles are possible.

Similar to the divider of FIGS. 1-4, the track 69 comprises a slot 71 having a opening 73. The opening 73 is defined by a first side 75*a* and second side 75*b* of a slot covering 75. In an exemplary implementation, both the front and rear panels 55 and 57 and the slot covering 75 are formed of a thermoplastic polymer, such as polypropylene, or other material. Thus, the slot covering 75 may be coupled to the rear panel 57 with heat welds 77*a* and 77*b* respectively associated with the first side 75*a* and second side 75*b* of slot covering 75.

The tab 53 comprises disks 81 that are received within the slot 71 to form a mating connection and allow the tab to slide along the track 69. The disks 81 are slidable within the slot 71 along the first track portion 69*a*, second track portion 69*b*, and corner track portion 69*c*. To facilitate sliding the disks 81 about corner track portion 69*c*, the corner track portion may be curved, as shown in FIG. 12. Optionally, a reinforcement panel portion (not shown) may be coupled to the outer-facing surface of the rear panel 57 adjacent the rear side of the track 69. The reinforcement panel portion may be used to reinforce the track 69 and/or provide greater stiffness.

FIG. 13 shows a cross-sectional view of the mating interface between the tab 53 and the track 69, taken across line b-b in FIG. 12. The disks 81 are coupled to the tab 53 via fasteners 83, which may comprise eyelets, rivets, brads, or other fastening means. The fasteners 83 each comprise a head 83*a*, a post 83*b* and a base 83*c*. The head 83*a* of the fastener 83 is located exterior to the slot 71 and is coupled to the post 83*b*. The post 83*b* of the fastener passes through the tab 53 and the slot opening 73. The base 83*c* of the fastener 83, which is also coupled to the post 83*b*, is located interior to the slot 71, between the disk 81 and the rear panel 57. The post 83*b* has a smaller diameter than the slot opening 73 and is movable along the slot opening. The disk 81 slides within the slot 71 and has a sufficiently larger diameter than the slot opening 73 to prevent the tab 53 from detaching from the track 69.

Figure 14:
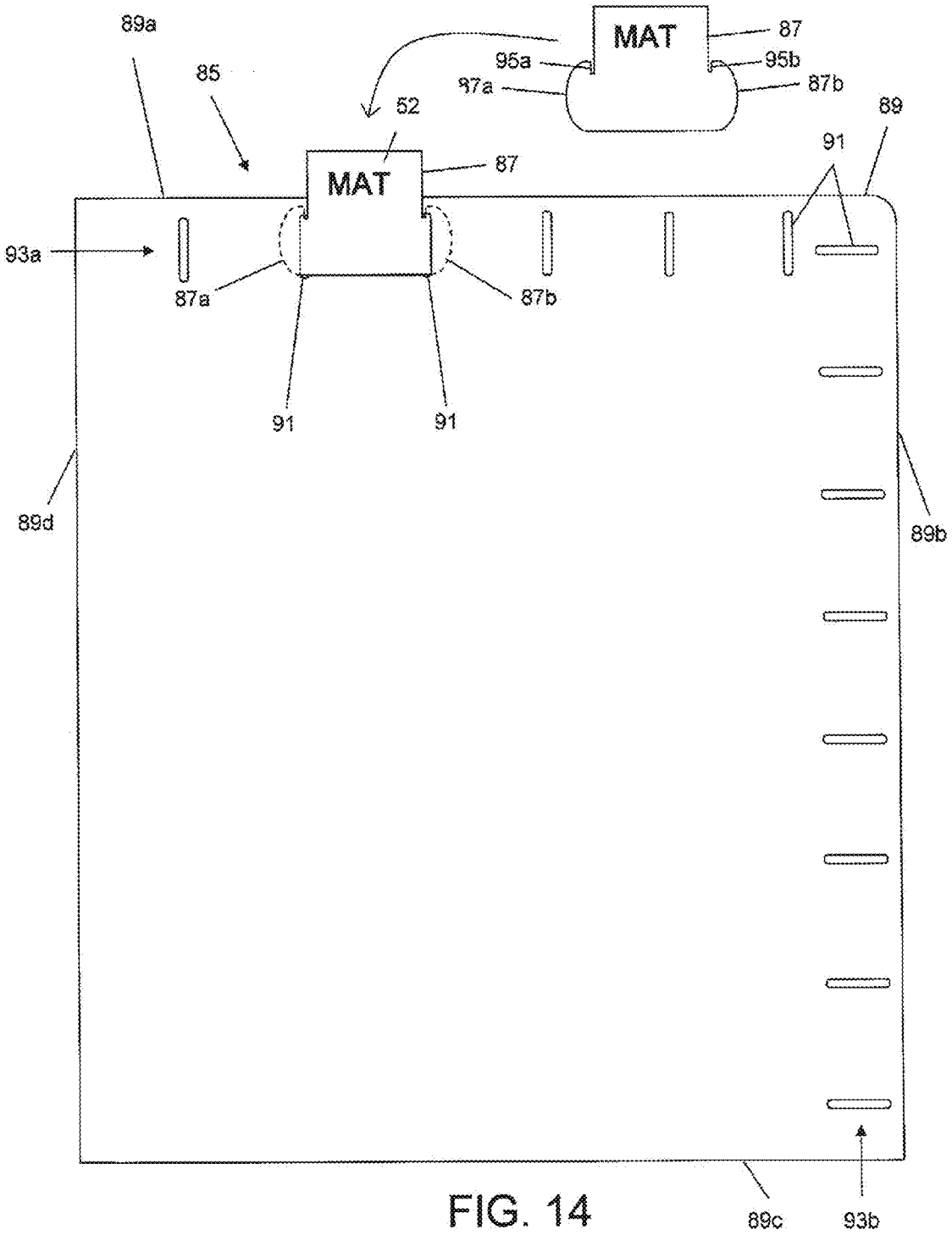
FIG. 14 shows a front view of a folder having a removable and repositionable tab.

FIG. 14 illustrates another embodiment of a folder 85 having a repositionable tab 87, wherein, similar to the divider of FIGS. 5-6, the folder includes a plurality of rows of slots along which the tab is positionable. The folder may be constructed of first and second panels configured as shown in FIGS. 10-13, and may have any of the features described in connection with the folder 51 of the embodiment of FIGS. 10-13. The front panel 89 of the folder 85 is visible in FIG. 14.

The front panel 89 comprises a plurality of rows of slots 91 along which the tab 87 is positionable. In the exemplary embodiment of FIG. 14, a first row 93*a* extends along a top edge 89*a* of the first panel 89 and a second row 93*b* extends along a right edge 89*b* of the front panel 89. Alternatively, however, the rows may extend along bottom edge 89*c*, along left edge 89*d*, along edges of the second panel (obscured in FIG. 14), and/or along the inner-facing surfaces of the folder 85 (not shown). The rows may comprise various numbers of slots 91 based, for example, on a desired number of slot pairs that may accommodate a tab and/or a desired width of the tabs. In the example shown, the folder 85 comprises five slot pairs (six slots) along top edge 89*a* and eight slot pairs (nine slots) along right edge 89*b*.

The slots 91 may be sized to accommodate ears 87*a* and 87*b* of the tab 87. For example, the slots 91 may have approximately the same height as the height of the ears 87*a* and 87*b*. The ears 87*a* and 87*b* may be inserted into adjacent slots 91. The ears 87*a* and 87*b* may include notches 95*a* and 95*b* to interface with the first panel 89 adjacent the slots 91 and hold the tab 87 in place one inserted. The size of the tab 87 and the location of the slots 91 relative to the edge of the front panel 89 may be selected such that the tab extends beyond the edge of the panel when inserted into the slots.

FIG. 14 illustrates the tab 87 positioned along the top edge 89*a*. The tab 87 may be provided with information 52 identifying or otherwise relating to the contents of the folder. The tab 87 may be repositioned by removing the tab and reinserting the tab at another location along the top edge or at a location along right edge 89*b*. The slots 91 provide flexibility to position the tab 87 at a plurality of locations along each of the top and right edges 89*a* and 89*b*. For additional flexibility, slots could be provided along additional edges of the folder.

Having described several illustrative embodiments of the invention, various alterations, modifications and improvements will readily occur to those skilled in the art. Such alterations, modifications and improvements are intended to be in the spirit and scope of the invention. Accordingly, the foregoing description is by way of example only and is not intended as limiting. The invention is limited only as defined in the following claims and the equivalence thereto.

What is claimed is:

1. A folder comprising:

a first panel comprising a first inner-facing surface and a first outer-facing surface;

a second panel, coupled to the first panel, comprising a second inner-facing surface and a second outer-facing surface, wherein the first and second panels are arranged such that at least a portion of the first inner-facing surface is adjacent at least a portion of the second inner-facing surface;

at least one tab mating feature associated with the second panel; and a tab configured to mate with the at least one tab mating feature;

wherein the at least one tab mating feature is configured such that the tab is positionable in at least two positions along a first axis adjacent a first edge of the second panel and in at least two positions along a second axis adjacent a second edge of the second panel, wherein the first axis is transverse to the second axis;

wherein the at least one tab mating feature comprises a track and the tab is configured to slide along the track; and wherein the track comprises a first track portion oriented along the first axis, a second track portion oriented along the second axis, and a corner track portion adjoining the first and second track portions such that the tab is slidable from the first track portion to the second track portion via the corner track portion.

2. The folder of claim 1, wherein the track comprises a slot and the tab comprises a slot mating feature that is configured to slide within the slot.

3. The folder of claim 2, wherein the slot mating feature comprises at least two disks.

4. The folder of claim 1, wherein the first track portion is perpendicular to the second track portion.

5. The folder of claim 1, wherein:

the first panel comprises a first left edge, a first right edge, a first top edge, and a first bottom edge the second panel comprises a second left edge, a second right edge, a second top edge, and a second bottom edge; and the first and second panels are coupled along the first and second left edges and the first and second bottom edges.

6. The folder of claim 5, wherein the at least one tab mating feature is located on the second inner-facing surface.

7. The folder of claim 6, wherein the at least one tab mating feature is located adjacent the second top edge and the second right edge.

8. The folder of claim 1, wherein the tab extends at least partially beyond the first edge when the tab is positioned in the at least two positions along the first axis, and extends at least partially beyond the second edge when the tab is positioned in the at least two positions along the second axis.

9. A method of adjusting a tab on a folder, the folder comprising a first panel, a second panel coupled to the first panel, at least one tab mating feature associated with the second panel, and a tab configured to mate with the at least one tab mating feature, the method comprising:

introducing at least one item between the first and second panels;

moving the tab from a first position along a first edge of the second panel to a second position along a second edge of the second panel; and providing the tab with information relating to the at least one item;

wherein moving the tab comprises sliding the tab from the first position to the second position along a track;

wherein the track comprises a first track portion adjacent the first edge, a second track portion adjacent the second edge, and a corner track portion adjoining the first and second track portions; and wherein moving the tab comprises sliding the tab from the first track portion to the second track portion via the corner track portion.

10. The method of claim 9, wherein moving the tab comprises moving the tab from the first position to the second position without decoupling the tab from the second panel.

11. The method of claim 9, wherein:

the first panel comprises a first left edge, a first right edge, a first top edge, a first bottom edge, a first inner-facing surface and a first outer-facing surface;

the second panel comprises a second left edge, a second right edge, a second top edge, a second bottom edge, a second inner-facing surface and a second outer-facing surface;

the first and second panels are arranged such that at least a portion of the first inner-facing surface is adjacent at least a portion of the second inner-facing surface; and the first and second panels are coupled along the first and second left edges and the first and second bottom edges.

12. A folder comprising:

a first panel comprising a first inner-facing surface and a first outer-facing surface;

a second panel, coupled to the first panel, comprising a second inner-facing surface and a second outer-facing surface, wherein the first and second panels are arranged such that at least a portion of the first inner-facing surface is adjacent at least a portion of the second inner-facing surface;

a track comprising a first track portion adjacent a first edge of the second panel and oriented along a first axis, a second track portion adjacent a second edge of the second panel and oriented along a second axis transverse to the first axis, and a corner track portion adjoining the first and second track portions; and a tab comprising a track-mating portion configured to couple the tab to the track in a manner such that the tab is slidable along the track from the first track portion to the second track portion via the corner track portion.

13. The folder of claim 12, wherein the track comprises a slot, and wherein the track mating portion comprises at least two disks that are slidable within the slot.

14. The folder of claim 12, wherein:

the first panel comprises a first left edge, a first right edge, a first top edge, and a first bottom edge the second panel comprises a second left edge, a second right edge, a second top edge, and a second bottom edge; and the first and second panels are coupled along the first and second left edges and the first and second bottom edges.

15. The folder of claim 14, wherein the at least one tab mating feature is located on the second inner-facing surface.

16. The folder of claim 15, wherein the at least one tab mating feature is located adjacent the second top edge and the second right edge.

17. The method of claim 9, wherein the first and second edges are non-parallel.

* * * * *